US010942464B2

(12) United States Patent
Tremitiere et al.

(10) Patent No.: US 10,942,464 B2
(45) Date of Patent: Mar. 9, 2021

(54) AMES NEGATIVE SUBLIMATION TONER

(71) Applicant: ESPRIX TECHNOLOGIES, LP., Sarasota, FL (US)

(72) Inventors: Tonya Tremitiere, Brandenton, FL (US); Mark William Cummings, Lakewood Ranch, FL (US); Jana Petrova, Ellenton, FL (US); Jeff Lee Morgan, Sarasota, FL (US); Mandy Lehman Smith, North Port, FL (US); John F Cooper, Hendersonville, NC (US)

( * ) Notice: Subject to any disclaimer, the term of this patent is extended or adjusted under 35 U.S.C. 154(b) by 0 days.

(21) Appl. No.: 16/493,059

(22) PCT Filed: Mar. 20, 2018

(86) PCT No.: PCT/US2018/023220

§ 371 (c)(1),
(2) Date: Sep. 11, 2019

(87) PCT Pub. No.: WO2018/175358

PCT Pub. Date: Sep. 27, 2018

(65) Prior Publication Data

US 2020/0133153 A1 Apr. 30, 2020

Related U.S. Application Data

(60) Provisional application No. 62/601,368, filed on Mar. 20, 2017.

(51) Int. Cl.

| | |
|---|---|
| ***G03G 9/08*** | (2006.01) |
| ***G03G 9/09*** | (2006.01) |
| ***G03G 9/087*** | (2006.01) |
| ***G03G 9/097*** | (2006.01) |

(52) U.S. Cl.

CPC ..... *G03G 9/0906* (2013.01); *G03G 9/0821* (2013.01); *G03G 9/08755* (2013.01); *G03G 9/09708* (2013.01); *G03G 9/09733* (2013.01)

(58) Field of Classification Search

CPC ..... G03G 9/0821; G03G 9/08755
USPC ..... 430/111.4
See application file for complete search history.

(56) References Cited

U.S. PATENT DOCUMENTS

| | | | | |
|---|---|---|---|---|
| 5,281,709 | A * | 1/1994 | Akiyama | C09B 67/0096 544/347 |
| 6,007,955 | A | 12/1999 | Verhecken et al. | |
| 6,143,454 | A | 11/2000 | Thompson | |
| 6,270,933 | B1 | 8/2001 | Thompson | |
| 7,919,221 | B2 | 4/2011 | Asami et al. | |
| 8,383,309 | B2 | 2/2013 | Wang et al. | |
| 8,398,224 | B2 | 3/2013 | Hale et al. | |
| 8,628,185 | B1 | 1/2014 | Hale et al. | |
| 8,709,696 | B2 | 4/2014 | Wang et al. | |
| 8,798,512 | B2 | 8/2014 | Okamoto et al. | |
| 9,170,514 | B2 | 10/2015 | Mural et al. | |
| 9,372,425 | B2 | 6/2016 | Wang et al. | |
| 2006/0111467 | A1 * | 5/2006 | Reinhardt | C09D 11/40 523/160 |
| 2012/0040281 | A1 * | 2/2012 | Wang | G03G 9/0918 430/48 |
| 2013/0084522 | A1 | 4/2013 | Klier et al. | |
| 2016/0209770 | A1 | 7/2016 | Nakamura et al. | |
| 2016/0246198 | A1 | 8/2016 | Fujisaki et al. | |
| 2017/0010551 | A1 | 1/2017 | Matsushima et al. | |
| 2017/0334227 | A1 * | 11/2017 | Greene | B44C 1/1712 |

FOREIGN PATENT DOCUMENTS

| | | | |
|---|---|---|---|
| JP | 4098153 | B2 | 6/2008 |
| JP | 4546841 | B2 | 9/2010 |
| JP | 4546908 | B2 | 9/2010 |
| JP | 4570854 | B2 | 10/2010 |
| JP | 4771899 | B2 | 9/2011 |
| JP | 4865586 | B2 | 2/2012 |
| JP | 201415685 | A | 1/2014 |
| JP | 5563381 | B2 | 7/2014 |
| JP | 201534362 | A | 2/2015 |
| JP | 201534363 | A | 2/2015 |
| JP | 5695352 | B2 | 4/2015 |
| JP | 5737907 | B2 | 6/2015 |
| JP | 2015113542 | A | 6/2015 |
| JP | 2015113543 | A | 6/2015 |
| JP | 2015129364 | A | 7/2015 |
| JP | 2015131934 | A | 7/2015 |
| JP | 2015158560 | A | 9/2015 |
| JP | 2016172807 | A | 9/2016 |
| JP | 2017132842 | A | 8/2017 |
| JP | 2018180301 | A | 11/2018 |
| JP | 2019012134 | A | 1/2019 |
| WO | 2015020165 | A1 | 2/2015 |
| WO | 2018020164 | A1 | 2/2018 |

OTHER PUBLICATIONS

Xerox Material Safety Data Sheet, MSDS No. OPB-6512, Oct. 24, 1995. (Year: 1995).*

International Search Report and Written Opinion of the International Search Authority received for corresponding Patent Cooperation Treaty Application No. PCT/US2018/023220, dated Jul. 17, 2018, 12 pages.

* cited by examiner

*Primary Examiner* — Mark A Chapman

(74) *Attorney, Agent, or Firm* — Dinsmore & Shohl LLP; Weston R. Gould

(57) ABSTRACT

Provided are toners and combinations of toners that demonstrate excellent color and are Ames test negative in both *Salmonella typhimurium* strains TA98 and TAIOO.

20 Claims, No Drawings

AMES NEGATIVE SUBLIMATION TONER

CROSS REFERENCE TO RELATED APPLICATIONS

This application depends from and claims priority to U.S. Provisional Application 62/601,368 filed Mar. 20, 2017, the entire contents of which are incorporated herein by reference.

FIELD

This disclosure provides a specific set of dye sublimation dry toners to be used in dry toner-based printing systems where each individual toner is Anes-negative. Specific combinations of solvent or disperse dyes may be further combined with appropriate polymers, charge control agents, waxes and additional additives by any one of the known conventional or chemical toner preparation processes.

DISCLOSURE

Dry and liquid toners used for printing electrophotographic, magnetographic or electron deposition images are well known. Such compositions typically include polymer binders, black or color pigments and additional components such as waxes, charge agents and usually additional surface additives. Such toners typically include black or color dyes and pigments chosen for a desired optical property such as its hue or optical density. It is also known that alternative dyes or pigments could be included in a toner composition to achieve another desired affect such as for example the printing of colorless dyes on a substrate for a security application.

Many solvent and disperse "heat transfer" or "sublimation" dyes can also be included in a toner formulation for purposes other than providing a particular hue to a printed document. This unique class of colorants is solid at room temperature but upon heating at elevated temperature they transition to a gaseous state and then upon cooling become solid again. While in the gaseous state these dyes can migrate into certain types of textile fibers such as polyester, rayon or nylon. They can also be used to decorate items that have a dye-receptive surface. For example a toner can also be designed to be the carrier of such sublimation or heat transfer dyes whereby the dye-based toner image can first be printed on an intermediate "carrier" substrate and subsequently the dye alone transferred by heat to another substrate such as a textile or coated metal. As a simple example, a disperse dye mixture could be substituted for the usual color pigment in a standard toner formulation. These disperse dye-containing toners are printed onto plain paper as normal, with the exception that an image is usually printed in a reverse format. That printed sheet is placed in contact with a substrate to be decorated such as a polyester-based textile. The printed sheet and textile are heated, typically using a heat press, for sufficient time and pressure that the dye sublimes and transfers to the textile. The remaining toner components remain behind on the carrier sheet.

The concept of using sublimation dyes in dry toner formulations is not new. In the 70's a Swiss company Sublistatic Systems introduced a toner-based system using zinc oxide photoconductive paper (the output sheet) that was toned with a wax-based conductive magnetic toner that contained heat transfer dyes. They obtained a number of patents related to such toners. None of their toners were designed for use in hot-roll fused plain paper copiers or printers such as those in use today. During the 80's companies such as Colortone were selling monocolor Hewlett-Packard LaserJet® and CAMS full color toners that contained heat transfer dyes. There have also been a number of patents related to heat transfer toners. For example U.S. Pat. Nos. 5,555,813 and 5,590,600 to Sawgrass claimed toners where sublimable dyes were included in molecular sieves and the dye/sieve combination included in a dry toner formulation. Other specific sublimation toner patents included U.S. Pat. No. 6,007,955 to Agfa Gevaert, U.S. Pat. Nos. 6,143,454 and 6,270,933 to ICMI where the formulations related to using specific polymer binders. Nippon Kayaku patent application 20150286169 described a formulation using a specific toner additive. There have also been numerous patents where the inventor included disperse dyes as a potential colorant, but without the intention of transferring the dye in a sublimation process. In each of the above patents many possible disperse dyes were mentioned as possible candidates for dye sublimation printing.

These heat transfer toners must be designed to meet the usual functional requirements of the printer in which they will be used. They must also be designed to be toxicologically and environmentally safe and preferably provide a negative Ames test. The Ames test was developed by Professor Bruce Acnes in the 1970's as a convenient means of determining potential mutagenic potential of a compound. The test uses different strains of bacteria to predict probabilities of a compound to cause DNA mutations. The toner industry has come to rely on a negative Ames test as one criteria for determining suitability of a commercial toner. Although a positive Ames test in itself does not mean that a toner is necessarily harmful to humans, it can create a negative perception by users of such a product and thus the toner industry makes every effort not to have an Ames positive toner. A good reference to Ames test and imaging materials can be found in Peter Gregory's publication Chemistry and Technology of Printing and In aging Systems.

The vast majority of chemicals used to produce commercially available toners would produce a negative Ames Test. This is not necessarily the case with many sublimation solvent and disperse dyes that can have functional groups or even contaminants from their production that can result in their exhibiting a positive Ames Test. This can be a challenge to designers of heat transfer toners. A full color heat transfer toner set would require separate cyan, magenta, yellow and black dye-containing toners. The challenge is to select dyes that provide the desired transfer rate, hue, and light stability. Frequently there is not a single dye that will meet the desired characteristic and a best-alternative combination of dyes selected. This is especially true when designing cyan and particularly black heat transfer toners. For example there is no actual black heat transfer dye. Instead black can be achieved by combinations of cyan, magenta, yellow, orange and or brown dyes. The problem arises when certain dyes that could provide an optimum black mixture result in toners that provide a positive Ames test. A similar situation exists for cyan heat transfer toner. The inventors have determined that many of the sublimation toner patents mentioned above include disperse dyes that result in toners that provide a positive Ames Test. To solve this problem the inventors have researched both the type and concentration of disperse dye and the effect on Ames Test.

As mentioned earlier, a suitable sublimation dye transfer toner composition may also consist of one or more polymer binders, waxes or other lubricants, charge control agents, internal and/or external additives, in addition to the sublimation dyes. The major component of typical toners is 50-90 wt % of a polymer binder. Common binders that havebeen used for electrophotographic toners include polyester, styrene acrylic, styrene butadiene and epoxy resins. The vast majority of toners use some version of polyester or styrene acrylic polymer. Optional binders for the inventive toners provided herein, however, are binders with molecular weight and molecular weight distribution such that the toner will adequately fuse to the plain paper substrate but not transfer or offset to the printer's fuser rolls. It is desirable that a binder is also capable of uniformly dispersing the sublimation dye and other components. Optionally, a binder will have an intrinsic ability to electrostatically charge negative or positive as required by the final toner. It will also optimally have enough mechanical strength to survive the various electrophotographic process steps. Finally, the binder is optionally suitable for either conventional toner preparation techniques or one of the alternative chemical processes. For example, a conventional preparation technique involves extrusion of the polymers, charge agents, wax and dyes followed by jet milling and particle classification. Those particles may then be blended with surface additives to control charge, cleaning, flow or toner transfer. Chemical processes may involve emulsification of the polymer or solvent dissolution of the polymer. A second component can be an internal lubricant whose purpose is to provide substrate release during the hot melt fusing process of a typical laser printer. Common wax lubricants suitable for this purpose may include for example polyolefin, paraffin or ester waxes, depending on the particular polyester or styrene acrylic binder used. A third toner component can be charge modifying agents and this can be particularly critical with sublimation dye toners. The purpose of a charge agent is to provide a desired charge polarity, or improved charge rate and charge stability. It was mentioned earlier that very few disperse dyes meet all the desired characteristics for a sublimation toner. However, it is common to have disperse dyes with the optimum hue, transfer rate and light stability but with surface chemistry that can contribute to undesirable toner charge characteristics. In such a case one or more charge control agents can be included in the toner to adjust the toner charge polarity, rate or stability. The particular type and concentration of charge agent will vary depending on the disperse dye used.

Sublimation toners will typically be formulated using 3-10% of one or more solvents or disperse cyan, magenta, yellow and black dyes that can diffuse or sublime at elevated temperatures. There are only a limited number of such dyes that meet the desired characteristics of hue as well as transfer temperature and transfer rate. Some of the many possible disperse dyes mentioned in earlier patents include Yellow 54, Yellow 82, Yellow 119, Orange 25, Red 1, Red 4, Red 60, Violet 17, Red 364, Red 11, Blue 72, Blue 14, Blue 19, Blue 60, Blue 359, Blue 360 and Broom 26. Within this limited supply of available dyes it has been determined that many possible candidates do not by themselves meet the required toxicological properties and specifically they can give a positive Ames test. However, the inventors have determined that the concentration and purity of specific disperse dyes can influence the Ames test and this is especially true where mixtures of different dyes must be used to achieve a desired hue. For example, there is no pure black disperse dye. Instead mixtures of different dyes must be used to achieve the desired hue and density of the dyed image. This mixture might include cyan, magenta and yellow dyes. Or it might include a blue plus orange, brown or some combination of those. A similar situation exists for selecting magenta, yellow or cyan dye mixtures that will provide the desired full color transferred image. It has also been discovered by the inventors that one dye by itself might be Ames positive but when used at low concentration within a toner will produce an Ames negative toner.

As such, provided are toner compositions that include or more disperse dyes where the toner exhibits a negative Acnes test with strains TA98 and TA100. As described above, the inventors found that specific combinations of disperse dyes at desirable concentrations or single dyes when used at specific concentrations when in a final toner composition can yield excellent color transfer results as well as create a toner that is Ames test negative in both TA98 and TA100. Optionally, a toner includes one disperse dye. Optionally, a toner includes two or more disperse dyes. Optionally, a toner includes 1, 2, 3, 4, 5, 6, 7, 8, 9, 10 or more disperse dyes.

Supporting the dyes are other components of the toner composition. A toner composition as provided herein optionally includes a binder. The binder is optionally present from 70 to 95% by weight, or any value or range therebetween. A binder is optionally present at 75 to 95% by weight, optionally 80 to 90% by weight.

Optionally, a binder is a polyester polymer binder, a styrene acrylic binder, or combinations thereof. Illustrative examples of a polyester binder include those with a molecular weight 130,000 to 175,000, or any value or range therebetween, optionally with a number average molecular weight (Mn) of 3000 to 7000. Illustrate examples of polyester binders include polymers of bisphenol A and furmaric acid, or DIACRON polyesters from Dianal America, Inc.

In other aspects, a binder is optionally a styrene acrylate binder. Illustrative examples of a styrene acrylic binder include those with a molecular weight of 250,000 to 300,000 kDa and optionally a Mn of 3000 to 8000 Da. Illustrative examples of styrene acrylate resin binders include but are not limited to DIANAL FB-series resins available from Dianal America, Inc.

A toner has an overall color imparted by the one or more disperse dyes that are included in the resin. A disperse dye is optionally preset weight percent of 10% or less, optionally 9% or less, optionally at or less than 8, 7, 6, 5, 4, 3, 2, or 1 weight percent or less. When more than one disperse dye is present the total weight percent or the dyes are optionally 10% or less, optionally 9% or less, optionally at or less than 8, 7, 6, 5, 4, 3, 2, or 1 weight percent or less.

As is described above it was found in some aspects that the use of particular combinations of disperse dyes to form a toner composition could result in excellent color transfer and create a toner that is Ames test negative in both TA98 and TA100. Illustrative examples of disperse dyes that may be used in some aspects of a toner as provided herein include but are not limited to Yellow 54(CAS 12223-85-7), Yellow 82 (CAS 27425-55-4), Yellow 119 (CAS 57308-41-5), Orange 25 (CAS 31482-56-1), Red 1 (CAS 2872-52-8), Red 4 (CAS 2379-90-0), Red 11 (CAS 2872-48-2), Red 60 (CAS 17418-58-5), Red 364 (CAS 522-75-8), Violet 17 (CAS 12217-92-4), Blue 14 (CAS 2475-44-7), Blue 19 (CAS 4395-65-7), Blue 60 (GAS 12217-80-0/56548-64-), Blue 72 (CAS 12217-81-1), Blue 359 (CAS 62570-50-7), Blue 360 (CAS 885474-63-5), and Brown 26 (optionally as available from AAKASH CHEMICALS), or any combination thereof.

In some aspects, particular combinations of disperse dyes are used in a toner composition Optionally, a toner composition includes Yellow 54, Orange 25, Blue 60, Blue 72, Red 60, and Violet 17.

Optionally, a toner composition includes Red 60 and Violet 17. Optionally, the Red 60 is present at 2 to 6 wt %. Optionally, the violet 17 is preset at 0 to 3 wt %. Optionally, the toner composition includes from 2 to 6 wt % Red 60 and from 0 to 3 wt % Violet 17.

In some aspects a toner is a yellow toner that includes one or more disperse dyes so as to impart a yellow color to the toner. Optionally, a yellow toner includes as a disperse dye Yellow 54. Yellow 54 is optionally present at 1 to 5 wt %.

In other aspects, a toner is a cyan toner. Optionally a cyan toner includes one or more disperse dyes the combination of which imparts a cyan color to the toner. Optionally, a cyan toner includes as disperse dyes Blue 60, Blue 72, or combinations thereof. Optionally, a cyan toner includes 0 to 3 wt % Blue 60 and from 0 to 3 wt % Blue 72.

In some aspects, a toner includes one or more disperse dyes so as to impart a black color to the toner. A black toner optionally includes one or more of Violet 17, Yellow 54, Orange 25, and Blue 72. Optionally, the toner includes 0 to 0.2 wt % Violet 17, from 1 to 2 wt % Yellow 54, from 1 to 2 wt % Orange 25, and from 5 to 8 wt % Blue 72.

In some aspects a toner includes a single disperse dye. Optionally, a single disperse dye is Blue 60. Blue 60 is optionally present at 1 to 5 wt %, optionally 3 wt %.

A toner optionally includes one or more additives suitable to impart one or more other desired characteristics to the toner. An additive optionally is a lubricant such as a wax lubricant, a charge control agent, and one or more toner surface additives. Such additives and how to include them in a composition are known in the art.

Various aspects of the present invention are illustrated by the following non-limiting examples. The examples are for illustrative purposes and are not a limitation on any practice of the present invention. It will be understood that variations and modifications can be made without departing from the spirit and scope of the invention.

EXAMPLES

Example 1

A black toner was prepared by extruding a mixture of 86% polyester resin, 1% colorless zinc complex negative charge control agent, 3% ester wax and a total of 10% of a disperse dye mixture of 2.31% Violet 17, 0.94% Yellow 54, 0.42% Orange 25, 4.69% Blue 14 and 1.64% Red 60 where all percentages are weight percentages. The extruded mixture was jet milled, classified to remove fine particles and appropriate flow and cleaning additives applied to the toner surface for it to function properly in an Oki color printer. The toner gave a positive Ames test for TA 98 with metabolic activation but negative with TA100.

Example 2

A cyan toner was prepared as in example 1 but using 3 wt % Blue 14. This toner was Ames positive with TA 98 strain.

Example 3

A cyan toner was prepared as in example 1 but with 6 wt % dye mixture of 5.4 wt % Blue 60 and 0.6 wt % Blue 72. This toner was Ames positive with TA 98 strain.

Example 4

A cyan toner was prepared as in example 1 but replacing the disperse dyes with 1.5 wt % Blue 72. This toner was Ames negative for both TA 98 and TA 100 strains.

Example 5

A magenta toner was preared as in example 1 but replacing the disperse dyes with 1.5% Violet 17. This toner was Ames negative for both TA 98 and TA 100 strains.

Example 6

A magenta toner was preared as in example 1 but replacing the disperse dyes with 1.5% Red 60. This toner was Ames negative for both TA 98 and TA 100 strains.

Example 7

A yellow toner was premed as in example 1 but replacing the disperse dyes with 1% Yellow 54. This toner was Ames negative for both TA 98 and TA 100 strains.

Example 8

A black toner was prepared by extruding a mixture of 86% polyester resin, 1% colorless zinc complex negative charge control agent, 3% ester wax and a total of 10% of a disperse dye mixture of 2.31% Violet 17, 0.94% Yellow 54, 1% Orange 25, 6.5% Blue 72 where all percentages are weight percentages. The extruded mixture was jet milled, classified to remove fine particles and appropriate flow and cleaning additives applied to the toner surface for it to function properly in an Oki color printer. This toner was Ames negative for both TA 98 and TA 100 strains.

Various modifications of the present invention, in addition to those shown and described herein, will be apparent to those skilled in the art of the above description. Such modifications are also intended to fall within the scope of the appended claims.

It is appreciated that all reagents are obtainable by sources known in the art unless otherwise specified.

Patents, publications, and applications mentioned in the specification are indicative of the levels of those skilled in the art to which the invention pertains. These patents, publications, and applications are incorporated herein by reference to the same extent as if each individual patent, publication, or application was specifically and individually incorporated herein by reference.

The foregoing description is illustrative of particular embodiments of the invention, but is not meant to be a limitation upon the practice thereof. The following claims, including all equivalents thereof, are intended to define the scope of the invention.

The invention claimed is:

1. A yellow, magenta, cyan or black disperse dye-containing toner composition, said toner exhibits a negative Ames Test with strains TA98 and TA100, said toner compositions configured for use in sublimation dye transfer applications.

2. A toner according to claim 1 where the composition further comprises from 80-90 wt % of a polyester polymer binder, and optionally from 1 to 8 wt % wax lubricant, optionally from 1 to 4 wt % charge control agent, optionally from 2 to 12 wt % disperse dye and optionally from 1 to 5 wt % toner surface additives.

3. A toner according to claim 2 where the polyester polymer binder has a molecular weight in the range of 130,000 to 175,000 and Mn of 3000 to 7000.

4. A toner according to claim 2 where the charge control agent comprises 1 to 4 wt % of a zinc complex.

5. A toner according to claim 2 where the internal lubricant comprises 1 to 8 wt % polyolefin, hydrocarbon or ester wax.

6. A toner according to claim 2 where the toner surface additives are selected from the group consisting of silica, alumina, titanium dioxide, acrylic resin particles, zinc stearate, and strontium titanate.

7. A toner according to claim 1 where the disperse dyes are selected from the group consisting of Yellow 54, Yellow 82, Yellow 119, Orange 25, Red 1, Red 4, Red 11, Red 60, Red 364, Violet 17, Blue 14, Blue 19, Blue 60, Blue 72, Blue 359, Blue 360, Brown 26, and combinations thereof.

8. A toner according to claim 1 where the dyes are selected from the group consisting of Yellow 54, Orange 25, Blue 60, Blue 72, Red 60, and Violet 17.

9. A toner according to claim 1 where the toner is a magenta toner comprising from 2 to 6 wt % Red 60 and from 0 to 3 wt % Violet 17.

10. A toner according to claim 1 where the toner is a yellow toner comprising from 1 to 5 wt % Yellow 54.

11. A toner according to claim 1 where the toner is a cyan toner comprising from 0 to 3 wt % Blue 60 and from 0 to 3 wt % Blue 72.

12. A toner according to claim 1 wherein the toner is a black toner comprising from 0 to 0.2 wt % Violet 17, from 1 to 2 wt % Yellow 54, from 1 to 2 wt % Orange 25, and from 5 to 8 wt % Blue 72.

13. A toner according to claim 1 comprising 80-90 wt % of a styrene acrylic polymer binder, and optionally from 1 to 8 wt % wax lubricant, optionally from 1 to 4 wt % charge control agent, optionally from 2 to 12 wt % disperse dye, and optionally form 1 to 5 wt % toner surface additive(s).

14. A toner according to claim 13 where the styrene acrylic resin has a molecular weight of 250,000 to 300,000 and Mn of 3000 to 8000.

15. A toner according to claim 13 where the charge control agent comprises 1 to 4 wt % of a zinc complex.

16. A toner according to claim 13 where the wax lubricant comprises from 1 to 8 wt % polyolefin, hydrocarbon, or ester wax.

17. A toner according to claim 13 where the toner surface additives are selected from the group consisting of silica, alumina, titanium dioxide, acrylic resin particles, zinc stearate, and strontium titanate.

18. A toner according to claim 13 where the disperse dyes are selected from the group consisting of Yellow 54, Yellow 82, Yellow 119, Orange 25, Red 1, Red 4, Red 11, Red 60, Red 364, Violet 17, Blue 14, Blue 19, Blue 60, Blue 72, Blue 359, Blue 360, and Brown 26.

19. A toner according to claim 13 where the disperse dyes are selected from the group consisting of Yellow 54, Orange 25, Blue 60, Blue 72, Red 60, and Violet 17.

20. A toner according to claim 13 where the toner is:

a magenta toner comprising from 2 to 6 wt % Red 60 and from 0 to 3 wt % Violet 17;

a yellow toner comprising from 1 to 5 wt % Yellow 54;

a cyan toner comprising from 0 to 3 wt % Blue 60 and from 0 to 3 wt % Blue 72; or a black toner comprising from 0 to 0.2 wt % Violet 17, from 1 to 2 wt % Yellow 54, from 1 to 2 wt % Orange 25, and from 5 to 8 wt % Blue 72.

* * * * *